US006138538A

United States Patent [19]

Neijndorff

[11] Patent Number: 6,138,538

[45] Date of Patent: Oct. 31, 2000

[54] FINISH-PROTECTIVE TOOL PIECES AND FINISH-PROTECTIVE COLLARS

[76] Inventor: Eduard Neijndorff, 16250 Brandt, Romulus, Mich. 48174

[21] Appl. No.: 09/050,686

[22] Filed: Mar. 30, 1998

Related U.S. Application Data

[60] Provisional application No. 60/042,210, Mar. 31, 1997.

[51] Int. Cl.[7] ..... B25B 15/00

[52] U.S. Cl. ..... 81/451; 81/125; 81/185; 81/DIG. 11

[58] Field of Search ..... 81/451, 125, 185, 81/DIG. 11

[56] References Cited

U.S. PATENT DOCUMENTS

| | | |
|---|---|---|
| 657,457 | 9/1900 | Schneider . |
| 1,686,681 | 10/1928 | Canode . |
| 2,089,121 | 8/1937 | Hartung . |
| 2,688,991 | 9/1954 | Doyle . |
| 2,723,694 | 11/1955 | Ross . |
| 2,788,816 | 4/1957 | Dargols . |
| 2,829,685 | 4/1958 | Mitchell et al. . |
| 2,985,208 | 5/1961 | Hibbard et al. . |
| 3,135,306 | 6/1964 | Mangerian . |
| 3,392,767 | 7/1968 | Stillwagon . |
| 3,403,711 | 10/1968 | Moore . |
| 3,449,988 | 6/1969 | Gallo . |
| 3,517,714 | 6/1970 | Desbarats . |
| 3,583,451 | 6/1971 | Belvidere et al. . |
| 3,608,596 | 9/1971 | Yoho . |
| 3,616,827 | 11/1971 | Stillwagon . |
| 3,633,640 | 1/1972 | Moore . |
| 4,030,383 | 6/1977 | Wagner . |
| 4,221,249 | 9/1980 | Mazzeo et al. . |
| 4,704,929 | 11/1987 | Osada . |
| 4,825,732 | 5/1989 | Arnold . |
| 5,003,849 | 4/1991 | Lawrie . |
| 5,003,850 | 4/1991 | Harkins . |
| 5,009,133 | 4/1991 | Carey . |
| 5,029,498 | 7/1991 | Kinsey . |
| 5,101,698 | 4/1992 | Paradiso . |
| 5,176,050 | 1/1993 | Sauer et al. . |
| 5,309,799 | 5/1994 | Jore . |
| 5,520,075 | 5/1996 | Barmore ..... 81/437 |

FOREIGN PATENT DOCUMENTS

| | | |
|---|---|---|
| 1293018 | of 1952 | France . |
| 672898 | of 1952 | United Kingdom . |
| 700536 | of 1952 | United Kingdom . |

*Primary Examiner*—Timothy V. Eley
*Assistant Examiner*—Willie Berry, Jr.
*Attorney, Agent, or Firm*—Susan M. Cornwall; Lynn E. Cargill

[57] ABSTRACT

A finish-protective tool piece and a finish-protective tool piece collar are made from non-marring materials that circumferentially surround and secure a tool piece for rotating fasteners having driving heads. This collared tool piece or collar substantially protects against the marring and damaging of consumer item finishes during final stages of assembly by tool pieces skipping off the fastener heads during operation onto painted or otherwise finished surfaces. The collared tool piece or collar is being adapted for individual tool piece diameters or styles and rotates with the secured tool piece, said tool piece extending therethrough so as to be able to rotate the fastener. This invention has obvious cost advantages as it can prove useful in practically all aspects of consumer item manufacturing including automobiles, appliances, barbecues, furniture, bicycles, etc. Preventing scratches in manufactured goods with the tool piece collar is undoubtedly more cost effective and time saving than repairing and touching up marred painted surfaces.

15 Claims, 3 Drawing Sheets

FINISH-PROTECTIVE TOOL PIECES AND FINISH-PROTECTIVE COLLARS

This application claims the benefit of U.S. Provisional application No. 60/042,210, filed on Mar. 31, 1997.

TECHNOLOGICAL FIELD

The present invention relates to finish-protective tool pieces and finish-protective collars suitable for use on various tool pieces. The finish-protective tool pieces are useful for protecting a surface, especially a painted surface, while assembling consumer items ranging from refrigerators to automobiles, bicycles and the like.

BACKGROUND OF THE INVENTION

Customers of automobile dealerships, appliance stores and other sellers of consumer items are skeptical to accept products having scratched, painted surfaces. It is well-known in the industry that a customer will accept an automobile with loose parts before that same customer would accept an automobile with scratches in the paint. Customers know that the car dealer will be able to repair loose parts, but they do not trust the dealer to fix scratches in painted surfaces. Customers know that the dealer might say that the customer is the one who caused the scratch, refusing to acknowledge that the car was delivered that way from the factory. Recent statistics show that nearly 10% of all cars arrive at the car dealerships with imperfect paint finishes, resulting in rejection by the customer. Other painted items such as refrigerators, gas barbecue grills, bicycles and other painted items experience the same problems. Many of these imperfections in the painted surfaces occur during final assembly of the item. For example, after a car body has been painted, various moldings and other edge-covering pieces must be fastened to the automobile. Those moldings are generally fastened with screws, hex-heads, bolts, and the like. These finely finished consumer items need to be protected during assembly. As the moldings are being fastened over the "raw" edges of the freshly painted surfaces, the assembly person generally uses a power tool to secure the molding to the painted part. For instance, as one can imagine, the assembly person has a hard time keeping a power drill on top of a screw while mounting a window molding onto a freshly painted car body. People who have ever used a power drill know how hard it is to keep the metal screw bit from "skipping" off the end of the screwhead. Once the screw bit skips off the screwhead, it can easily scratch the surface nearby the screwhead. Fresh paint in an automotive plant, which damages more easily, adds another dimension of problems to the assembler. Imagine trying to screw a windshield molding onto a freshly painted car body when using an all metal air driven screwdriver without scratching the paint. These scratches require repair, or the customer is likely to reject the product.

Generally, manufactured consumer items are assembled through the use of driving tool pieces and bits by air driven or electric motor driven driving units. The tool pieces and bits may include screw bits, slotted heads, phillips heads, square-recesses, Torx™, alan heads, hex recesses, hex-heads, sockets, bolts or any other type of tool piece. Such tool pieces must be easily and rapidly mountable into the motor driven unit, not only to provide for use of a variety of different tool bit sizes or types, but also to efficiently and rapidly replace broken or damaged bits when necessary. For example, automotive assembly usually requires replacement of tool bits on every shift.

Despite the many years during which power-driven bits have been used for assembly purposes, no one has introduced into the market an inexpensive and uncomplicated device which allows fasteners to be steadied while driven, as well as while avoiding marring the surface. Many devices have been disclosed for the purpose of centering or otherwise locating drill bits. See, e.g. German Patent DE 29 16 808 and U.S. Pat. Nos. 4,375,341; 3,097,891; 2,788,684; 3,320,832; 3,381,551; 3,339,435; and 3,907,452. I discovered one surface protective fastener tool in U.S. Pat. No. 5,009,133, although it rotates on the surface on ball bearings. My invention demonstrates a clear advantage over U.S. Pat. No. 5,009,133 in that it does not constantly contact the surface. However, if my invention does touch the surface, it virtually eliminates damage.

In most of the prior art devices typified above, spring loaded collars permit axial movement of the tool bit within the collar. The hollow collars through which the drill bits are inserted and withdrawn are generally used to provide a centering or locating action. These references allow full axial movement of the bit within the collar. While devices of the spring loaded type of U.S. Pat. Nos. 3,907,452; 3,320,832; and 757,950 would be useful in preventing damage to a finish, these devices act to secure the collar frictionally against the surface while the tool bit rotates therein to turn the fastener into place. The prior art discovered by this inventor has not shown a collar that secures the tool bit and rotates with it, without touching the surface of the article. Furthermore, changing driving tool bits would be problematic in these devices.

Consequently, it would be desirable to provide a collared tool piece or collars for tool pieces designed for use during assembly of consumer items requiring fasteners, especially threaded fasteners, while alleviating the possibility of damaging the finish of such articles. It would be further desirable to provide such a tool piece collar having the flexibility to provide for rapid tool piece bit changes. Such collared tool pieces or the collars for surrounding tool pieces are most advantageously disposable when damaged so that significant cost is not incurred.

SUMMARY OF THE INVENTION

A new finish-protective, non-scratching collared tool piece, as well as a surrounding collar for a tool piece, is hereby being promoted for use in the rapid assembly of manufactured articles. My non-scratching collar surrounds the tool piece, and rotates with the tool piece, although the collar is designed to substantially avoid contact with the fresh surface of the article being manufactured. In one important embodiment, the collar extends to a length just shy of contacting the surface when the fastener is nearly embedded into the manufactured article. This new collar design will act to allow for full use of the tool piece to embed the fastener into the article, without frictionally engaging or touching the surface when the fastener has been totally embedded into the article. Consequently, on some of my tool piece collars, they will extend beyond the tool piece itself because the head of the fastener will act to hold it up from the surface of the manufactured article.

In my other tool piece collars, where the fastener goes flush against the article, the tool piece itself will extend slightly beyond the collar so that the collar does not come in contact with the surface. Regardless of what type of fastener is being driven into the manufactured article, the end result is that the collar will rarely touch, but will come very close to touching, the surface of the molding or whatever is being attached to the manufactured article. Various examples will be described hereinbelow to illustrate my concept.

For example, in the manufacture of automobiles, "beauty" moldings are fastened around the raw edges of the painted car buck. The car buck is made of a metal stamping, and the molding is made of a metal stamping. The two pieces are fastened together with threaded fasteners, such as screws. On current model cars, weight and mileage considerations dictate that the metal stampings need to be very thin, and thin sheet metal is easily damaged. Additionally, the new environmentally friendly paints do not dry quickly and can become "burned" if a prior art frictionally engaging surface protective tool is used, such as the tools described in U.S. Pat. No. 5,009,313. These two environmental developments necessitate protective measures while manufacturing in order to produce a good marketable automobile.

The instant new finished-protective, non-scratching collared tool piece may include any category of tool piece, i.e. screw bits, slotted heads, phillips heads, square-recesses, alan heads, hex recesses, hex-heads, sockets, bolts, or any other type of tool piece. The finish-protective tool piece has an individualized non-marring collar surrounding the tool piece such that when the tool piece is in operation, the non-marring collar substantially alleviates damage to the surrounding painted surface. Furthermore, specific tool pieces may have one of my finish-protective collars placed therearound in order to give protection to the finished surface.

The collar itself should be made of a material that will not mar the surface, such as polymers, plastics, or any other suitable material that will not scratch the paint. The collar should be made of a material that will be softer than the painted surface into which the fasteners are being driven. As the overall objective of my invention is to prevent scratching or marring of the painted surface, the collar should surround the tool piece and the head of the fastener, while being positioned close to the surface, and only mistakenly touching the surface of the manufactured article.

The collar is shaped to receive individual tool pieces. Each collar will be specific for a specific tool piece. For example, a slotted screwdriver head would have a complementary tool piece collar designed specifically for that slotted screwdriver tool piece. If the slotted fastener is a flush mount fastener, the tool piece would extend about 1/64th inch to about 1/8th inch from the outer edge of the collar. If the slotted fastener had a 1/4 inch head thereon, the collar would surround the slotted screwdriver tool piece, and would extend beyond the slotted tool piece but would not extend past the lower portion of the screw fastener head.

The collar is adapted to tightly grip the slotted screwdriver tool driver bit so that it will rotate simultaneously along with the tool driver bit while embedding the fastener. The rear end of the collar would surround the securing end of the tool driver piece, and would be adapted for surrounding the chuck of the power driven tool driving unit. This embodiment could generally be classified as a "static" design.

In another embodiment of my invention, I have a "compressible" design for use in countersinking applications. The compressible design includes at least three pieces, including a compressible bushing, especially useful with countersinking bits with a collar for the tool bit; a slide shaft; and a connector. The compressible bushing nests onto the other components such that the collar extends to perform its function of protecting the finish of the surface, while the compressible bushing allows for countersinking the fastener, while absorbing some of the force exerted by the assembly person while driving a counter-sink bit into a molding or other surface. This design shall be disclosed hereinbelow with greater reference to the drawings.

In yet another embodiment of the present invention, a finish-protective collar is also disclosed, independent of the tool piece. Customers that have their own tool pieces may be interested in just purchasing the collar.

DETAILED DESCRIPTION OF THE INVENTION

In accordance with the present invention, the desired advantages are addressed as follows. A tool piece collar assembly capable of diminishing damage to nearby surfaces of fastened areas is made of a tool piece inserted into a mating finish-protective collar for securely holding the tool piece, such as a screw driver bit, hex-head bit, etc. which is connected to an air or power driven motor. Disclosed are various tool piece collar assemblies (tool bit-collar combination) and finish-protective collars (without the tool piece) for assembling manufactured articles. The tool piece collar has shown itself to be very effective in diminishing surface defects in areas nearby fastened moldings.

Figure 1:
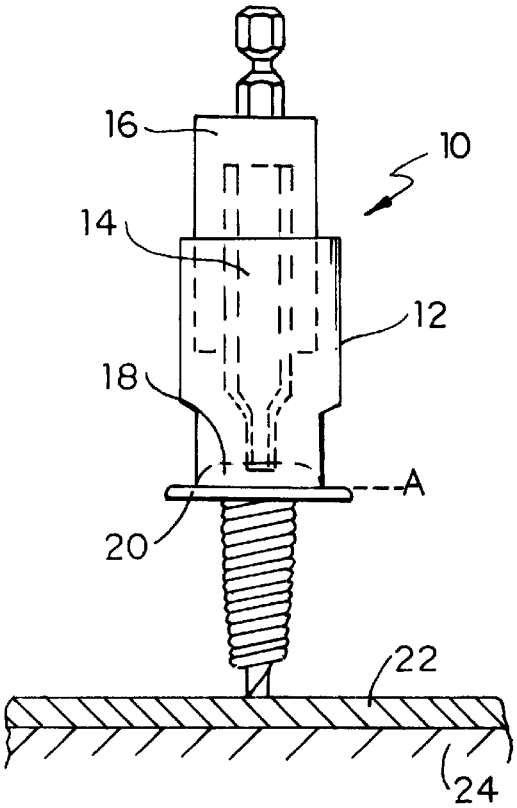
FIG. 1 is a cross-section through the axis of a tool piece collar assembly in accordance with an embodiment of the present invention, said assembly having a polymeric molded collar specifically adapted for the disclosed tool piece.

Referring first to FIG. 1, a tool piece collar assembly is generally denoted by numeral 10. The tool piece collar assembly includes a tool piece collar 12, and a tool piece 14. The collar assembly may be attached to a power driving unit 16, or other air power driving units, as well as electric power driving units. Power driving unit 16 may be a standard apex magnetic adapter, which is standard in the industry, or it may be a direct connection to the power driven unit. However, such a magnetic adapter is common in the automotive assembly field. The magnetic adapter may include a sheath which fits over the apex bit at one end and over my tool bit collar on the other end, as seen in FIG. 1. FIG. 1 illustrates a raised hex-head fastener 18 as an example of a fastener that might be used. Fastener 18 has a raised cap which fits into the recess within the tool piece collar and has a fastener cap 20. The threaded hex-head fastener is most commonly used in automobile applications, where a molding 22 is being fastened to a painted surface 24.

As can be seen in FIG. 1, tool piece collar 12 includes a recess specifically adapted for receiving hex-head fastener 18. Tool piece collar 12 is adapted individually for each common fastener for best results. Collar 12 meets the fastener cap 20 at point A. As one can see from the illustration, tool piece collar 12, once engaged over raised cap fastener 18, would be unlikely to skip off fastener 18 and mar the painted surface 24.

Figure 2:
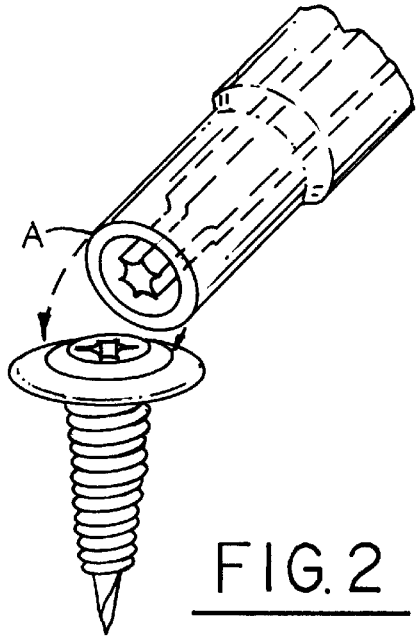
FIG. 2 is an exploded perspective view of the tool piece collar with a hex head tool bit imbedded therein, positioned over a threaded hex head fastener common in the automotive industry.

Referring next to FIG. 2, this is an exploded perspective view of the embodiment of FIG. 1. The recessed portion of tool piece collar 12 is more clearly shown with the hex-head tip of tool bit 14 being sized to fit within the hex-head opening of hex-head fastener 18. Tool piece collar 12 meets at point A to fastener cap 20, thereby essentially eliminating any contact between tool bit 14 and painted surface 24.

Figure 3:
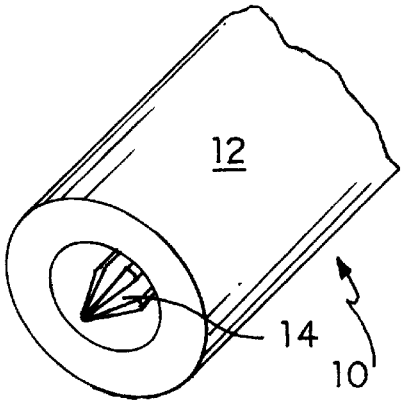
FIG. 3 is an illustration of one embodiment of a tool piece collar adapted for a phillips head type screwdriver bit, showing the tool bit slightly extending beyond the outer dimension of the tool piece collar.

Looking now to FIG. 3, tool piece collar assembly 10 is shown with another embodiment, in which tool bit 14 extends downwardly from tool piece collar 12.

As shown more clearly in FIG. 4, the tip of tool bit 14 extends a distance B below the lower perimeter of tool piece collar 12. Distance B is predetermined to allow for full embedding of a fastener without the collar making contact with the painted surface of the molding or the surrounded area.

As can be imagined, all of the various types of fasteners are too numerous to list here, although the overall concept of the tool piece collar being frictionally engaged over a tool piece or tool bit, with having the collar rarely touch the painted surface, is the overriding consideration. The length of the extension of the tool bit is adapted to the particular type of bit, and in general, the collar, after being held upwardly by the tool bit being inserted into the recess in the end of the particular fastener, should extend minimally about 0.001 inch beyond the tip of the bit, and most preferably, about 0.005 to about 0.08 inches. Most preferably, the collar is held upwardly about 0.04 to 0.06 inches from the lowermost tip of the tool, or away from the painted surface, so as to avoid contact as much as possible. However, should contact occur, damage to the painted surface would be minimal.

It must also be understood that a locating device, or locating "well", such as illustrated in FIGS. 1 & 2, may be appropriately recessed into the tip of the tool piece collar so as to "hold" the fastener in a proper angular relationship with the collar to ensure better penetration in order to accommodate fasteners with a raised head. As the raised head fasteners are limited in size categories, it is easy for one to see that individually complementary tool bit collar assemblies can be made for use with each and every particular raised head fastener. FIG. 2 clearly illustrates a popular raised platform hex-head fastener and a complementary tool bit collar and tool bit having a locator "well" A. It must be made clear that although I am proposing numerous tool bit collar tip designs, it is within the scope of the invention because my principle can be applied to most of the hundreds or thousands of different types of fasteners that are available. FIGS. 1 and 2 show one such type. This particular locator "well" design also ensures that a portion of the tool bit will extend beyond the bottom periphery of the collar without allowing the tool bit to directly contact the painted surface. Please not that the device of FIG. 4 does not include such a locating "well". Some tool bit collar assemblies made in accordance with the present invention are designed to be used with flathead fasteners.

The tool piece collar is preferably a polymeric material having at least some elasticity, for example, an ABS elastomer, SAN elastomer, a polyurethane elastomer, or the like. This helps to ensure that the tool bit may be inserted into the collar and will be securely fastened by the interaction between the collar and the tool bit, such that the bottom clearance between the end of the tool bit and the collar will be maintained, while still allowing the collar to be inserted around the tool bit with ease. The memory of an elastomeric material will also help to "snug" the collar around the tool bit. Elastomers with Shore hardnesses in the range of Shore A30 to Shore D90 may be used. Polymers such as polyethylene, polypropylene, and nylon are also particularly useful.

Although most of the tool bit collar assemblies in accordance with my invention will be disposed of when the tool bit becomes worn, it is envisioned that some customers will want to save the polymeric collar and replace the tool piece itself. To facilitate replacement of such a worn tool bit, tool piece collar 12 may have a central opening which is the same size internally as the exterior dimensions of the tool bit itself. Preferably, a projecting ring would be inside the collar to provide the axial location function, and snugly secure the tool piece into the collar. In such cases, harder but still resilient thermoplastics such as nylon, propylene, and the like are preferably used, as insertion of the tool bit into the collar only requires slight compression of a relatively thin locating ring. Additionally, two locating rings may be included, close to the tip of tool bit 14 as well as near the end which is received by the chuck of the power driving unit 16. In the alternative, the entire tool piece collar assembly 10 may be disposable if it was deemed that insertion time was worth more than the cost of the tool piece collar 12. Consequently, the tool bit 14 along with the tool piece collar 12 would be thrown out, and a fresh tool piece collar assembly used.

Figure 4:
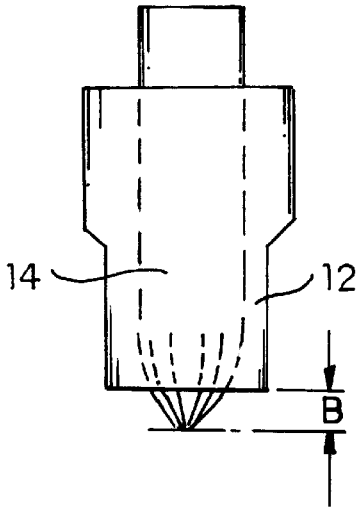
FIG. 4 is a side elevational view of the embodiment illustrated in FIG. 3, further detailing the extending tip of the phillips head tool bit.
Figure 5A:
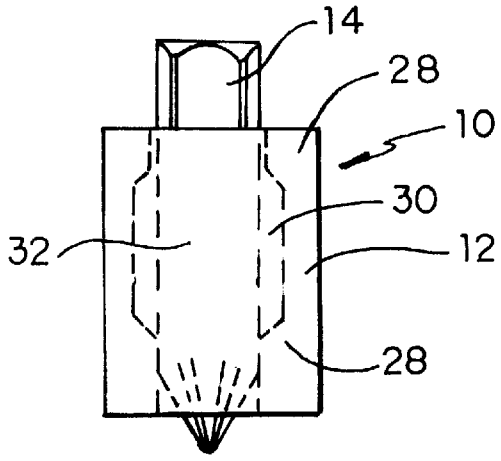
FIG. 5A illustrates another embodiment of the tool piece within the collar.
Figure 5B:
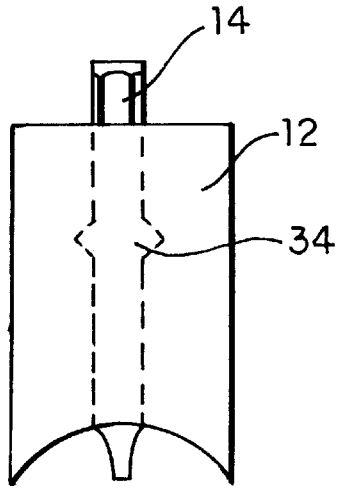
FIG. 5B illustrates another embodiment of the tool piece within the collar.

In yet another embodiment, FIGS. 5A and 5B show various designs as they may be adapted for the tool piece collar 12 to secure tool bit 14 therein, including a near-shape cavity within collar 12 to receive tool bit 14. As discussed hereinabove, at least one complementary snugging ring 28 through which the tool piece or tool bit 14 can be forced therethrough may be included. It would be particularly useful if the snugging rings, as shown in FIG. 5A, would act to cooperate for indexing the tool piece collar 12 in an axial direction relative to tool bit 14. Many equivalent indexing devices or arrangements are of course possible, and most are known in the art. Another of these is shown in FIG. 5B. It is most helpful that movement in the axial direction away from the driving end of the tool bit 14 be limited. Movement of collar 12 toward the bit end may be tolerated, although the tolerance for distance B, as shown in FIG. 4, would be lessened.

In yet another embodiment, tool piece collar 12, may be injection molded around tool piece 14 to form a tool piece collar assembly, which fully secures the collar 12 around the tool bit 14, as shown in FIG. 4.

When molding the plastic collar around the driving bit, traditional injection molding equipment may be used, with magnetic or other type of clamps to secure the driving bit while the thermoplastic collar is molded around it. The thermoplastic may be selected from a wide variety of injection moldable thermoplastics, such as, but not limited to, polyethylene, polypropylene, nylon, polyester, ABS, SAN, polystyrene, polycarbonate, polyacrylate, and the like. For a longer wearing life and/or when higher strength is required, high performance thermoplastics such as polyaramide, polyethersulfone, polysulfone, polyetherketone, polyetherimide, polyimide, and the like may be used, but are not necessarily preferred.

The benefit of the subject invention polymer collars is that they may be manufactured at low cost, whether of the injection molded collar assembly variety, or the insertable stand-alone collar variety. Because the tip of the driving bit or socket does not extend to the tip of the polymer collar, the driving bit or socket, customarily of relatively hard steel, cannot contact the finish surface into or through which the fastener is being driven. Thus, if the driving bit slides off the fastener while the tool is still running, which is often the case, only the relatively soft polymer collar will contact the painted surface, thus minimizing the possibility of damage. Likewise, if the tool is accidentally misdirected at other times, the hard bit is likewise prevented from contacting finished surfaces.

Figure 6A:
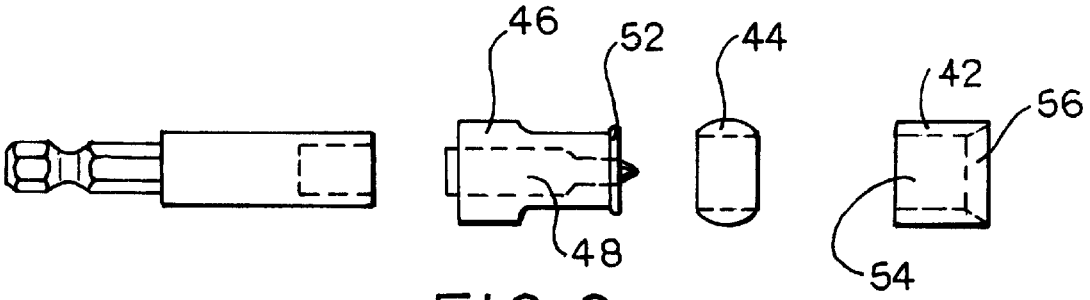
FIG. 6A is an exploded perspective view of another embodiment of the present invention, including a compressible bushing, and illustrates the three piece construction and assembly.
Figure 6B:
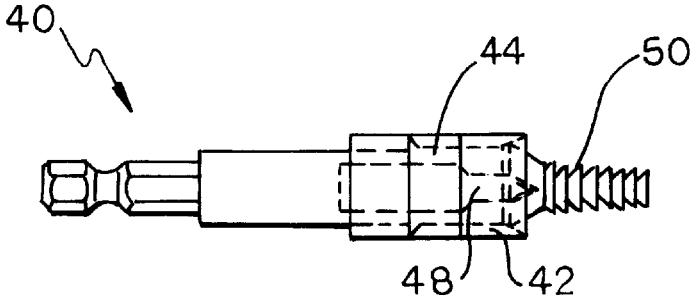
FIG. 6B is a side elevational view of the assembled compressible tool piece collar assembly; and, FIGS. 7A through 7F illustrates yet another embodiment of the present invention which is directed toward a finish-protective socket-collar assembly and the collar without the socket.

Looking now to FIG. 6, another preferred embodiment of the present invention is shown which discloses a compressible tool bit collar assembly, especially for counter-sinking, illustrated in FIGS. 6A & 6B. Compressible tool bit collar assembly, generally denoted by numeral 40, includes a slide shaft 42, an elastomeric bushing 44, and a tool bit holder 46 for circumferentially surrounding and securing tool bit 48. This three piece construction acts as a compressible collar because tool bit 48 may be pushed against a complementary fastener 50 while bushing 44 is capable of taking some of the force by the assembly person. The snap ring rim 52 of tool bit holder 46 contacts the outer rim of, for example, a counter-sinking screw 50, and is capable of thoroughly embedding the fastener into the manufactured article. As one can see from FIG. 6A, tool bit holder 46 receives bushing 44 thereover and is snap fitted within a recess in tool slide shaft 42 and is capable of sliding therein. Consequently, the snap ring rim 52 of tool bit holder 46 pushes against compressible bushing 44. Tool bit holder 46 will not push backwards through slide shaft 42 because slide shaft 42 has a recessed portion 54 which has a different, larger diameter than throughbore 56. During operation, slide shaft 42 will tend to spin around tool bit holder 46.

Bushing 44 is preferably made of a urethane rubber or other suitable material of an undetermined durameter strength. Bit holder 46 may include a magnetized end for securing the fastener. This magnetized end may be adapted for use with a standard apex magnetic adapter. Force against the chuck end of the power driving unit (not shown), will butt up against the proximal end of bit holder 46, frictionally gripping elastomeric bushing 44, and transfers that torsional momentum in a radial direction against tool slide shaft 42, which in turn, will rotate and secure fastener 50 in place.

Figure 7A:
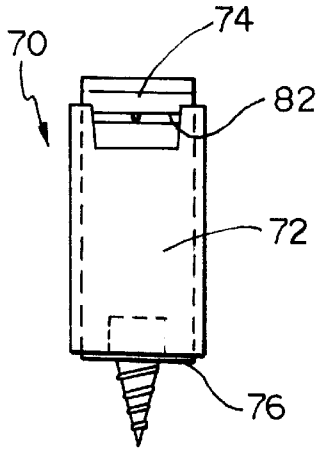
Figure 7B:
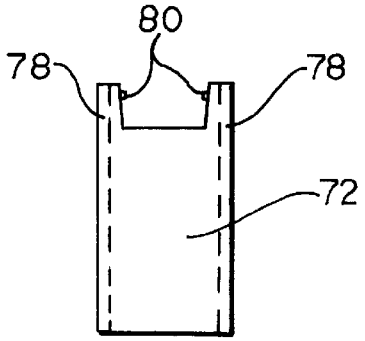

With combined reference to FIGS. 7A through 7E, yet another embodiment of the present invention is shown for a socket-collar combination as well as the collar itself. This design would be considered "static", as there are no moving parts as in the compressible embodiment described hereinabove. The socket and collar combination assembly is generally denoted by numeral 70, and includes a collar 72 surrounding a ridged socket 74 for driving a fastener 76. Other types of sockets may require minor modifications. FIG. 7B illustrates the preferred collar embodiment without the socket inserted therein. Collar 72 preferably includes two snap ring portions 78 with inwardly projecting ridges 80 to clip into the socket ridges 82.

Figure 7C:
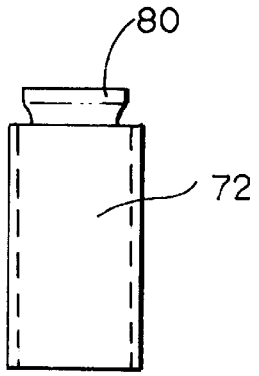
Figure 7D:
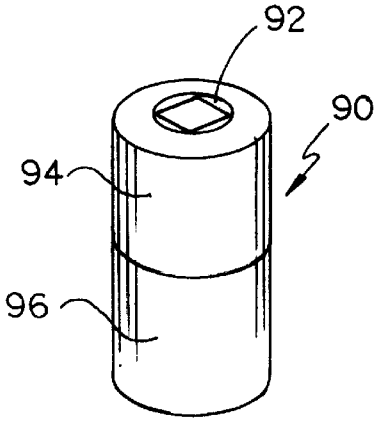
Figure 7E:
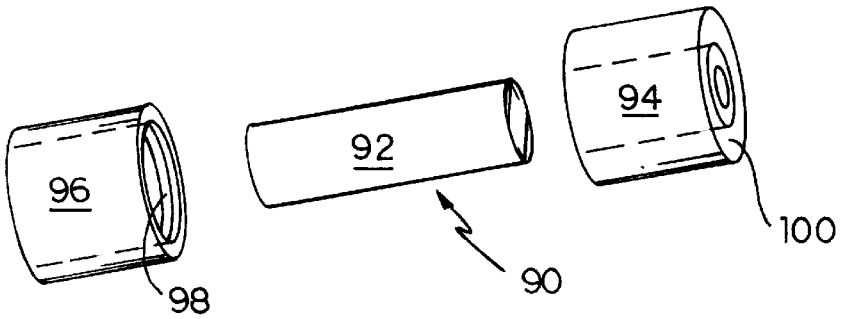

Other embodiments include a solid walled socket as shown in FIGS. 7D and 7E. Referring to FIGS. 7D and 7E simultaneously, the assembled socket-collar assembly combination is generally denoted by numeral 90. Socket 92 is encased by a two-piece collar, with top collar piece 94 covering the socket tool end, and bottom collar piece 96 covering the bottom fastener end of socket 92. Both top and bottom collar pieces 94 and 96 have lips 98 and 100, respectively, to hold socket 92 therein. The lips 98 and 100 necessitated the two piece collar, as assembly would be impossible otherwise. Lip 98 acts as a non-marring surface if the socket becomes disengaged from the fastener. FIG. 7C illustrates the collar without the socket again, just turned 90° from FIG. 7B and illustrates the snap ring ridge inside that will fit into the socket ridge. FIG. 7E shows an exploded perspective of the socket-collar assembly 70 as it relates to fastener 76. Please note that fastener 76 has a fastener cap which contacts the surface. The socket collar helps the socket tool described herein from contacting and/or marring the neighboring surface.

By the above description of the various embodiments of the present invention, all of the desired advantages have been met by the present invention.

One can readily see the cost advantages to the assembly of consumer devices, for example, automobiles, appliances, barbecues, bicycles, children's toys, furniture, and the like. However, the greatest savings appears to be in the automotive industry, where numerous fasteners must be driven, particularly into the ends of door panels and the like, all without marring the surface. If the surface is marred during assembly, the car must be routed from the assembly line through a special section of the manufacturing facility designed for touch-up paint work. Such touch up operations are exceptionally costly to the automotive industry, and raise the price of vehicles and decrease profit margins appropriately.

Having now fully described the invention, it will be apparent to one of ordinary skill in the art that many changes and modifications can be made thereto without departing from the spirit or scope of the invention as set forth herein.

What is claimed is:

1. A protective tool piece collar for a tool piece designed for rotating fasteners into a surface, the collar for protecting the surface from potential damage caused by the tool piece accidentally skipping off the fastener during use, the collar, comprising a slide shaft;

a compressible bushing; and a tool piece holder slidably affixed to the slide shaft through an opening in the bushing, said tool piece collar adapted for rotating with a tool piece therein in order to substantially diminish marring of nearby painted surfaces in case of tool piece run-off.

2. The protective tool piece collar of claim 1, wherein the compressible bushing is selected from the group consisting of bushings, O-rings, foam, rubber bands, urethanes, and other circular shaped materials of a soft durameter.

3. The collar of claim 2, wherein said tool piece collar is a multipiece interlocking mechanism.

4. The tool piece collar of claim 3, wherein said tool piece collar is adapted for securing and fully embedding countersinking fasteners.

5. A finish-protective tool piece, comprising:

a) a driving tool piece having a driving end adapted in size and shape so as to mate with a fastener to be driven;

b) a finish-protective collar surrounding a portion of said driving tool piece so that the driving tool piece extends therethrough, said collar being formed of a resilient molded elastomer polymeric material having a hardness between Shore A30 and Shore D90, and being fixed in position axially relative to said driving tool piece by a locating device that is a circumferentially extending device surrounding said driving tool piece, acting complementary and cooperatively with said driving tool piece, and having an opening in an end thereof in close proximity to said driving end of said driving tool piece, said opening being adapted in shape to receive the driving end of a fastener to be driven, the end of said driving tool piece extending slightly beyond the collar.

6. The finish-protective tool piece of claim 5, wherein the tool piece is selected from the group consisting of screw bits, slotted heads, phillips heads, square-recesses, hex recesses, hex-heads, sockets, and bolts.

7. The finish-protective tool piece of claim 5, wherein said collar is injection molded of polymer around said driving tool piece.

8. The finish-protective tool piece of claim 5, wherein said collar extends beyond the end of said driving tool piece by from about 0.001 inch to about 0.080 inch.

9. The finish-protective tool piece of claim 5, wherein said collar extends beyond the end of said driving tool piece by from about 0.040 inch to about 0.060 inch.

10. The finish-protective tool piece of claim 5, wherein said locating device comprises a section of increased diameter around said driving tool piece such that said elastomeric collar cannot proceed further in an axial direction than the shoulder of said enlarged portion.

11. A collared driving bit, comprising:

a) a driving bit having a driving end adapted in size and shape so as to mate with a fastener to be driven;

b) a collar surrounding a portion of said driving bit so that the driving bit extends therethrough, said collar being formed of a resilient molded elastomer polymeric material having a hardness between Shore A30 and Shore D90, and being fixed in position axially relative to said driving bit by a locating device which is a circumferentially extending device surrounding said driving bit, acting complementary and cooperatively with said driving bit, and having an opening in an end thereof in close proximity to said driving end of said driving bit, said opening being adapted in shape to receive the driving end of a fastener to be driven, the end of said driving bit extending slightly beyond the collar.

12. The collared driving bit of claim 11, wherein said collar is injection molded of polymer around said driving bit.

13. The collared driving bit of claim 11, wherein said collar extends beyond the end of said driving bit by from about 0.001 inch to about 0.080 inch.

14. The collared driving bit of claim 11, wherein said collar extends beyond the end of said driving bit by from about 0.040 inch to about 0.060 inch.

15. The collared driving bit of claim 11, wherein said locating device comprises a section of increased diameter around said driving bit such that said elastomeric collar cannot proceed further in an axial direction than the shoulder of said enlarged portion.

* * * * *